United States Patent [19]

Chevriot et al.

[11] 3,993,117

[45] Nov. 23, 1976

[54] METHOD FOR INCREASING THE MECHANICAL RESISTANCE OF FOUNDRY MOULDS OR CORES MADE FROM A SELF-HARDENING LIQUID SAND AND A RESIN AS BINDING AGENT

[75] Inventors: Roland F. Chevriot, Sainte-Genevieve-des-Bois; Marcel P. Gonon, Saint-Martin-le-Vinoux; Gilles Le Maux, Woippy; Daniel Mangin, Foug, all of France

[73] Assignees: Centre Technique des Industries de la Fonderie; Wendel Sidelor; Industries Chimiques de Voreppe, all of France

[22] Filed: Aug. 12, 1974

[21] Appl. No.: 496,770

Related U.S. Application Data

[63] Continuation of Ser. No. 344,621, March 26, 1973, abandoned, and a continuation-in-part of Ser. No. 333,868, Feb. 20, 1973, Pat. No. 3,857,712, which is a continuation of Ser. No. 160,026, July 6, 1971, abandoned.

[30] Foreign Application Priority Data

Mar. 27, 1972 France ..... 72.10727

[52] U.S. Cl. ..... 164/43; 260/39 SB; 260/29.4 R; 260/DIG. 40; 264/219

[51] Int. Cl.[2] ..... C08L 61/20; B22C 1/22

[58] Field of Search .... 260/29.4 R, 39 SB, DIG. 40; 164/43

[56] References Cited

UNITED STATES PATENTS

| | | | |
|---|---|---|---|
| 2,993,016 | 7/1961 | Sucetti | 260/29.4 R |
| 3,360,492 | 12/1967 | Tsou | 260/29.4 R |
| 3,424,600 | 1/1969 | Liass et al. | 106/38.3 |
| 3,615,755 | 10/1971 | Uto et al. | 106/38.35 |
| 3,644,274 | 2/1972 | Maurukas | 260/DIG. 40 |
| 3,725,090 | 4/1973 | Lyass et al. | 106/38.35 |

*Primary Examiner*—Lorenzo B. Hayes
*Attorney, Agent, or Firm*—Bucknam and Archer

[57] ABSTRACT

Foundry moulds and cores of increased mechanical resistance are prepared from sand, a binding agent, a setting agent, and a surface active agent, the binding agent being a urea-formaldehyde resin or a urea-formaldehyde-furfuryl alcohol resin, the surface active agent being capable of producing a foam which begins to subside before the sand begins to set, the surface-active agent being selected from the group consisting of an alkylbenzene sulphonate, an alkylamine salt of formula $RNH_2,YH$ in which R is an alkyl group of more than 9 carbon atoms and Y is the anionic portion of an acid or a compound of formula:

$$R-CONH-CH_2-CH_2-OCO-\underset{\underset{SO_3Me}{|}}{CH}-CH_2-CO_2Me$$

in which R represents an alkyl group having more than 9 carbon atoms and Me is an alkali metal; in the proportion of 0.01 to 2% by weight of surface-active agent with respect to the total weight of the liquid sand. Particularly effective are n-dodecylbenzene sulphonate and tetra-isobutyl sulphonate.

4 Claims, 11 Drawing Figures

Figure 1:
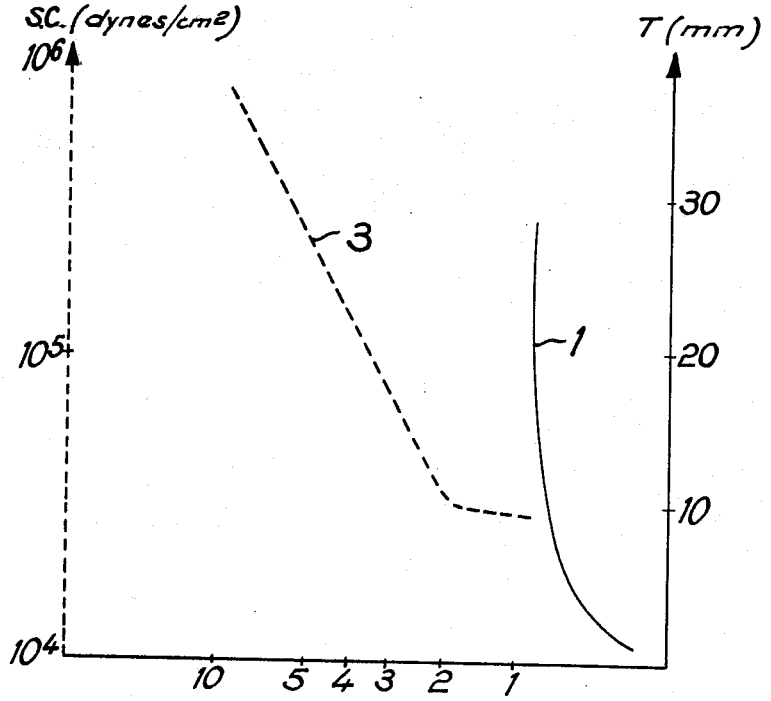

METHOD FOR INCREASING THE MECHANICAL RESISTANCE OF FOUNDRY MOULDS OR CORES MADE FROM A SELF-HARDENING LIQUID SAND AND A RESIN AS BINDING AGENT

This is a continuation of application Ser. No. 344,621 filed Mar. 26, 1973, now abandoned and a continuation-in-part of application Ser. No. 333,868 filed Feb. 20, 1973, now U.S. Pat. No. 3,857,712 which is a continuation of application Ser. No. 160,026 filed July 6, 1971, now abandoned.

U.S. Ser. No. 333,868, which is a continuation of Ser. No. 160,026 and which has issued as U.S. Pat. No. 3,857,712 on Dec. 31, 1974 relates to a method for increasing the density and, at the same time, the mechanical resistance of foundry moulds and cores made from a self-hardening liquid sand comprising a refractory sand, a binding agent, a hardening agent for the binder, a liquid and a surface-active agent. For fluidizing the sand mixture said method consists of using a surface-active agent which produces a foam, the lasting time of which, (i.e. the time which passes before it begins to subside) is less than the time which passes before the sand begins to set. For further increasing the density of the sand, and the mechanical resistance of the moulds, said method also consists of subjecting the sand to pressure and/or repeated mechanical stresses by vibration, shaking or the like, between the time when the sand becomes permeable (i.e. the time when the foam bubbles burst) and the time when it begins to set.

The aforesaid patent application also relates to the choice of surface-active agents to be used in the aforedescribed method when the binding agent is an alkali metal silicate.

The present application relates to a method for increasing the mechanical resistance of foundry moulds and cores according to the aforesaid patent application which is applicable to self-hardening liquid sands, the binding agent of which is a synthetic resin of the urea-formaldehyde type.

According to the present invention there is provided a method of preparing foundry moulds and cores of increased mechanical resistance from a self hardening liquid sand containing a urea-formaldehyde resin or a urea- formaldehyde-furfuryl alcohol resin as a binding agent and a surface active agent capable of producing a foam which begins to subside before the sand begins to set, characterised in that the surface-active agent is chosen from one of the following:

a. an alkylbenzene sulphonate of formula I;

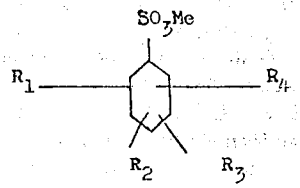

(I)

(in which $R_1$,$R_2$,$R_3$,$R_4$ each represent an atom of hydrogen, or an alkyl group, the alkyl groups having a total of more than nine carbon atoms and occupying any position on the benzene ring with respect to the sulphonyl group, and Me represents a hydrogen atom, an alkali metal or an HX group, X being an amine) alone or mixed with an alkylbenzene sulphonate of formula II;

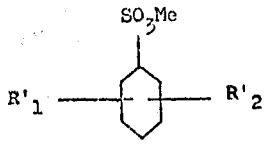

(II)

in which $R'_1$ and $R'_2$ each represent an atom of hydrogen or an alkyl group having 1 to 3 carbon atoms and Me is as previously;

b. an alkylamine salt of the formula:

$$RNH_2, YH \qquad (III)$$

in which R is an alkyl group of more than nine carbon atoms and Y is the anionic portion of an acid;

c. a compound of formula:

$$R-CONH-CH_2-CH_2-OCO-\underset{\underset{SO_3Me}{|}}{CH}-CH_2-CO_2Me$$

in which R represents an alkyl group having more than nine carbon atoms and Me is an alkali metal; in the proportion of 0.01 to 2% by weight of surface-active agent with respect to the total weight of the liquid sand.

Non-liquid sand mixtures having a urea-formaldehyde resin binding agent are used in the manufacture of cores of complicated shape, on account of their good aptitude for stripping. However these mixtures require high vibrational forces or packing by hand in order to avoid faulty packing. It was thus advantageous to develop liquid sand mixtures, comprising a urea-formaldehyde resin as binding agent, useful for the manufacture of cores of complicated shape and which did not require packing. The method according to the invention also makes it possible to increase the density of the sand, and consequently the mechanical resistance of cores made therefrom by use of a surface-active agent appropriate for the liquid sands having a urea-formaldehyde resin as binding agent. In this case, the use of the method according to the invention makes it possible not only to increase the mechanical resistance of the moulds and cores, but also to reduce the setting time of the liquid sand and to give it a setting time comparable with that of non-liquid sands.

Binding agents of the urea-formaldehyde type comprise urea-formaldehyde condensation polymers, preferably mixed with furfuryl alcohol, and urea-formaldehyde-furfuryl alcohol polycondensates.

The initial urea-formaldehyde polymers are of a standard type and have a formaldehyde/urea ratio (F/U) between 1 and 4, a percentage of dry material from 30 to 80% and a viscosity from 3 to 30 poises. They may be used either alone or together with a very small amount of furfuryl alcohol also, in order to fluidize the sand mixture, it is necessary to add a solvent such as an alcohol or a ketone (see Example 1 hereinafter); the sands obtained in this case are used specifically for moulding light alloys. Often it is preferable to use the urea-formaldehyde resin mixed with up to 55% of furfuryl alcohol with 45% urea- formaldehyde resin. The furfuryl alcohol simultaneously fulfils the function of fluidizing agent for the sand mixture and anti-forming agent.

Attempts have been made to increase the percentage of furfuryl alcohol mixed with the urea-formaldehyde resin in order to decrease risk of faults produced in the metal due to nitrogen coming from the degradation of the urea-formaldehyde resin at the time of moulding, but, above 55% the furfuryl alcohol completely prevents the foam from forming and the sand can no longer be liquified even in the presence of considerable quantities of surface tension agents.

However, it has been possible to increase the percentage of furfuryl alcohol up to 85% by introducing the latter into the resin in a polymerized form. Thus, in the method according to the invention, there have been used as binding agents for the liquid sands;

a. urea-formaldehyde-furfuryl alcohol polycondensates, designated hereinafter by the term "(U/F-/FA) poly condensates" and obtained by the polycondensation of a mixture of urea, formaldehyde and furfuryl alcohol in the presence of an alkaline catalyst;
b. mixtures of urea-formaldehyde resin and a furfuryl alcohol-formaldehyde precondensate, these mixtures being designated hereafter by the term; "(FA/F) plus UF";
c. resins obtained by the prepolymerization of a mixture of furfuryl alcohol and a urea-formaldehyde resin, of low viscosity, designated hereafter by the term; "(FA/UF) resins";
d. resins obtained by a further polymerization of the prepolymers (c) above, by boiling for half an hour in the presence of an acid catalyst followed by neutralisation; they are designated hereinafter by the term; "superpolymerized" (FA UF) resins;
e. mixtures of precondensate of furfuryl alcohol and a urea-formaldehyde resin, designated hereinafter by the term; "(FA) + UF resins";
f. mixtures of resins c or d, either with a urea-formaldehyde resin or with furfuryl alcohol.

It has thus been possible to introduce up to 85% of furfuryl alcohol into the binding agent provided that it is at least in a partially polymerized form provided by the resins a,b,c,d,e, and f.

The precondensates of furfuryl alcohol used as basic materials for the preparation of resins (e) may be obtained, for example, by the following manner;

A solution of 2,000g of furfuryl alcohol and 200g of water to which 10g diluted phosphoric acid is added is refluxed. When the desired degree of polycondensation is achieved, the pH is adjusted to 5–6 and the water is distilled off under reduced pressure.

The precondensates of furfuryl alcohol and formaldehyde used as basic materials for the preparation of the resins (b) may be obtained, for example, in the following manner;

A solution of 1500g furfuryl alcohol, 750g of a 40% solution of formaldehyde and 10ml of diluted phosphoric acid is refluxed for 30 minutes to several hours according to the desired degree of polycondensation. The pH is then adjusted to 5–6 and the water is distilled off at reduced pressure.

Urea-formaldehyde resins and urea-formaldehyde-furfuryl alcohol resins are preferably incorporated in the liquid sand mixtures in the proportion of 0.5 to 5% by weight of sand used.

The liquid sand mixtures comprising urea-formaldehyde resins are binding agents also contain a setting catalyst which is a mineral or organic acid, in particular, phosphoric, sulpuric, sulphonic acids and water, or an alcohol or ketone.

According to the invention, it has been found that the density of liquid sand mixtures whose binding agent is a urea-formaldehyde resin or urea-formaldehyde-furfuryl alcohol resin is increased by using an alkylbenzene sulphonate of the following formula as a surface-active agent;

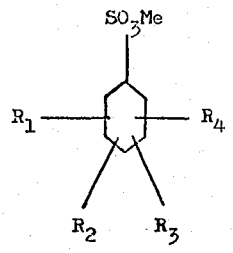

(I)

in which $R_1$,$R_2$,$R_3$,$R_4$ represent an atom of hydrogen or an alkyl group, the alkyl groups have a total of more than nine carbon atoms and occupy any position on the benzene ring with respect to the sulphonate group and Me represents an atom of hydrogen, an alkaline metal atom or an HX group, X being an amine.

The compound of formula (I) may be used alone or mixed with alkylbenzene sulphonate of the formula;

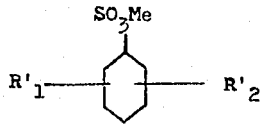

(II)

in which $R'_1$ and $R'_2$ each represent an atom of hydrogen or an alkyl group having 1–3 carbon atoms.

The surface-active agents of formula I used are preferably, n-dodecylbenzene sulphonate and tetra-isopropylbenzene sulphonate. Each of these compounds may be used alone as a surface-active agent. However, it is preferred to use a mixture of one of these compounds with an alkylbenzene sulphonate of formula II, a function of which is to increase the solubility of the surface-active agent (I) in water and acids and to decrease the stability of its foams.

The alkylbenzene sulphonates of formula II used are for example: Benzene sulphonate, dimethylbenzene sulphonate, isopropylbenzene sulphonate, di-ethylbenzene sulphonate and preferably p-toluene sulphonate.

The compounds of formula I and those of formula II are preferably added to the liquid sand in the form of the free sulphonic acid (Me representing a hydrogen atom). They thus act not only as surface-active agents, but also, with the other acids added to the sand mixture, as setting catalysts. They may be added in the form of their alkali metal salts or their amine salts; but in the presence of the acid catalyst added as setting agent ($PO_4H_3$ or $SO_4H_2$), they nevertheless act in the mixture in the form of the free acid.

On the other hand, it has been found that it is possible to increase the density of liquid sands, whose binding agent is a resin of the urea- formaldehyde type, by using as a surface-active agent either a cation-active agent, i.e. an alkylamine salt of the formula R—N $H_2$, YH, in which Y represents the anionic portion of an acid and the R is an alkyl group having more than 9 carbon atoms and in particular laurylamine acetate and oleylamine acetate, or an anion-active compound of the formula

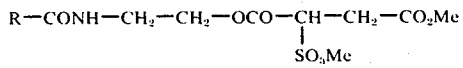

in which R is an alkyl group of more than 9 carbon atoms and Me is an alkali metal, in particular an alkali metal mono-laurylethanolamide-sulphosuccinate.

In all cases, the surface-active agent is added to the liquid sand in the proportion of 0.01 to 2% of the total weight of the sand mixture.

The ensuing non limiting examples are intended to illustrate the object of the application. For each of these examples, in the same manner as described in the aforesad application, the following curves have been drawn;

1. a curve of the compression T, of the sand expressed in millimeters on a linear scale, as a function of time *t* expressed in minutes on a logarithmic scale; this curve drawn as a thin solid line is designated by the general reference 1;
2. a curve of the setting of the sand giving the shearing threshold SC (or consistency), expressed in dynes /cm$^2$, measured on a logarithmic scale as a function of time *t* as previously; it is drawn as a thick broken line and has the general reference 3, the tests having been carried out by causing an additional compression of the sand by vibration or shaking, before setting;
3. a permeability curve giving the index of permeability *p* expressed as an AFS index and measured on a logarithmic scale as a function of time *t*, as previously; this curve being designated by the general reference 4 and drawn as a thick solid line.

In fact, this curve could only be drawn for example 2 hereinafter. In the other examples, the phenomenon of permeability occurred so rapidly that the permeability curves could not be drawn.

The sand was subjected to vibrations or shaking as soon as natural compression of the sand had occurred.

EXAMPLE 1 (FIG. 1)

A liquid sand is made with the following constituents;

—50kg of silica sand, the mesh size of which is 60 AFS (Americal standard);

—1 kg of urea-formaldehyde resin, whose characteristics are as follows; F/U = 1.9, percentage dry material; 66, viscosity; V = 30 poises, pH = 7.5 index of refraction (IR) = 1.46;

—0.492 kg acetone;

—0.600 kg water;

—0.108 kg n-dodecylbenzene sulphonic acid constituting the surface-active agent.

These constituents are mixed in a mixer as described in the patent application, by firstly mixing the neutral constitutents, i.e. the sand and resin, for 1 min, then adding the liquid constituents i.e. the acetone, water and surface-active agent and mixing for 30 seconds. The various stages are carried out at a temperature of 18° to 20° C and the curves 1 and 3 are drawn as described in the aforesaid Patent Application. These curves are illustrated in the graph of FIG. 1. The fluidity of this liquid sand was such that, measured with an Abrahms cone as described in the aforesaid patent application, the diameter over which the sand spread on the plate was 370 mm. The permeability could not be measured due to the rapidity of this phenomenon and the sand mixture was vibrated as soon as the sand had settled naturally i.e. at the end of a short period which was no longer than two minutes. Thus, after vibration, a settling of 70 mm had occurred and the density of the sand was 1.55. The resistance to compression of the liquid sand thus obtained was measured and the following results were obtained;

— at the end of 30 minutes ($R_c$ 0.5); 3.9 daM/cm$^2$,

— at the end of 1 hour ($R_c$ 1); 6.0 daN/cm$^2$,

— at the end of 5 hours ($R_c$ 5); 11.0 daN/cm$^2$,

— at the end of 24 hours ($R_c$ 24); 15 daN/cm$^2$.

In the same manner as previously another liquid sand is made with the following constituents;

— 50kg silica sand. (mesh size 60 AFS)

— 1kg urea-formaldehyde resin having the same characteristics as previously,

— 0.11 kg furfuryl alcohol,

— 696 g water,

— 46 g phosphoric acid,

— 13 g dodecylbenzene sulphonic acid, and

— 45 g p-toluene sulphonic acid fulfilling the function of surface- tension agents.

The mixture is produced by firstly mixing sand, resin and furfuryl alcohol for 1 minute, then, after adding the other liquid constituents, mixing for a further 30 seconds. The sand thus produced has the same characteristics as the sand obtained previously and the curves 1 and 3 virtually identical.

This example shows that it is possible to increase the density of a liquid sand whose binding agent is a urea-formaldehyde resin either alone or with the addition of a little furfuryl alcohol, using a surface-active agent which is either n-dodecylbenzene sulphonic acid alone, or a mixture of this acid with p-toluene sulphonic acid.

These sands, whose binding agent is a urea-formaldehyde resin, are used particularly for moulding light alloys, the resin decomposing at about 700° C but not reacting with these light alloys.

EXAMPLE 2(FIG. 2.)

A liquid sand is made with the following constituents;

— 50 kg silica sand having a mesh size 60 AFS,

— 1 kg of a mixture constituted by 45% urea-formaldehyde resin and 55% furfuryl alcohol; the urea-formaldehyde resin having the following characteristics; F/U: 1.6; percentage dry material: 60; viscosity: 6 poises; pH 7.5; IR: 1.46; the urea- formaldehyde-furfuryl alcohol resin mixture having a viscosity of 0.6 poise and a refraction index of 1.48.

— 15 g 85% phosphoric acid;

— 9 g sulphuric acid;

— 5 g methanol;

— 550 g water;

— 6 g dodecylbenzene sulphonic acid and

— 10 g p-toluene sulphonic acid as surface-active agents.

The sand and resin were mixed for 1 minute, the other constituents are then added and mixing was carried out for a further 30 seconds.

Figure 2:
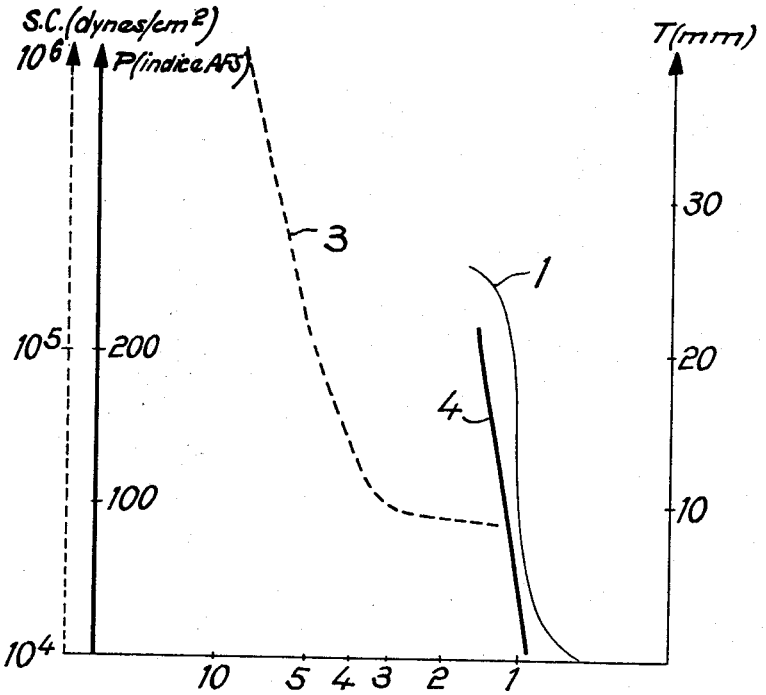

The various stages are carried out at a temperature of 18° to 20° C and the curves 1, 3 and 4 are drawn as described in the aforesaid Patent Application. These curves are illustrated in the graph of FIG. 2.

The sand thus prepared had the following characteristics: its fluidity, measured as previously described such that the diameter over which it spread was 370 mm; the settling obtained after vibrating the sand in 100 mm and the density of the obtained sand was 1.60.

Measurements of mechanical resistance to compression gave the following results:

$R_c$ 30 minutes: 1 daN/cm²
$R_c$ 1 hour: 6 daN/cm²
$R_c$ 5 hours: 11 daN/cm²
$R_c$ 24 hours: 17 daN/cm²

EXAMPLE 3 (FIG. 3)

A liquid sand was prepared with the following constituents:

— 50 kg silica sand having a mesh size of 60 AFS,
— 1 kg of a mixture of 45% urea-formaldehyde resin and 55% furfuryl alcohol, the urea-formaldehyde resin having the following characteristics; F/U = 1.8, dry material: 56%, viscosity: 3 poises; pH 8; IR: 1.46; the urea-formaldehyde-furfuryl alcohol resin mixture had a viscosity of 0.5 poise and a refraction index of 1.48.

The other constituents of the liquid sand mixture were as in the preceding example, in the same quantities with the exclusion of methanol.

The mixture was produced in the same manner as described in example 2 and the liquid sand obtained had the following characteristics:

— diameter over which it spread: 370 mm;
— settlement after vibration: 100 mm;
— density: 1.60;
— resistance to compression:
$R_c$ 30 minutes; 2 daN/cm²
$R_c$ 1 hour: 12 daN/cm²
$R_c$ 5 hours: 17 daN/cm²
$R_c$ 24 hours: 20 daN/cm²

Figure 3:
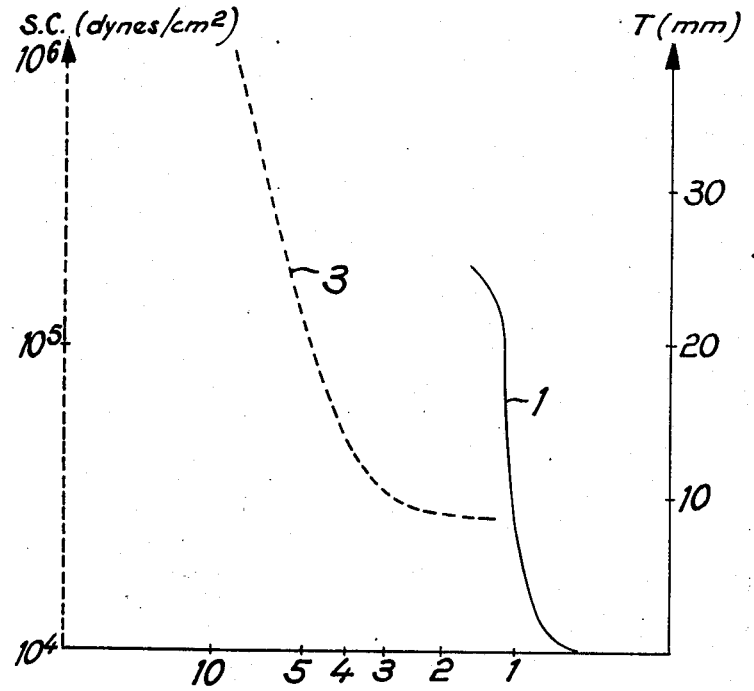

The curves 1 and 3 are as shown in FIG. 3.

EXAMPLE 4 (FIG. 4)

A liquid sand was prepared with the same constituents as in Example 3, but 1.5% of the urea-formaldehyde-furfuryl alcohol resin mixture was used (instead of 2%). The quantities of the various constituents were thus as follows;

— 50 kg silica sand, having a mesh size of 60AFS;
— 0.750 kg of a mixture of 45% urea-formaldehyde and 55% furfuryl alcohol resin
— 201 g phosphoric acid;
— 138 g sulphuric acid;
— 561 g water;
— 58 g dodecylbenzene sulphonic acid and 102 g p-toluene sulphonic acid as surface-active agents.

A liquid sand was obtained having the following characteristics;

— diameter over which it spread: 370 mm;
— settlement after vibration: 90 mm;
— density 1.60;
— resistance to compression:
$R_c$ 30 minutes: 1 daN/cm²;
$R_c$ 1 hour: 3 daN/cm²;
$R_c$ 5 hours: 5 daN/cm²;
$R_c$ 24 hours: 8 daN/cm².

Figure 4:
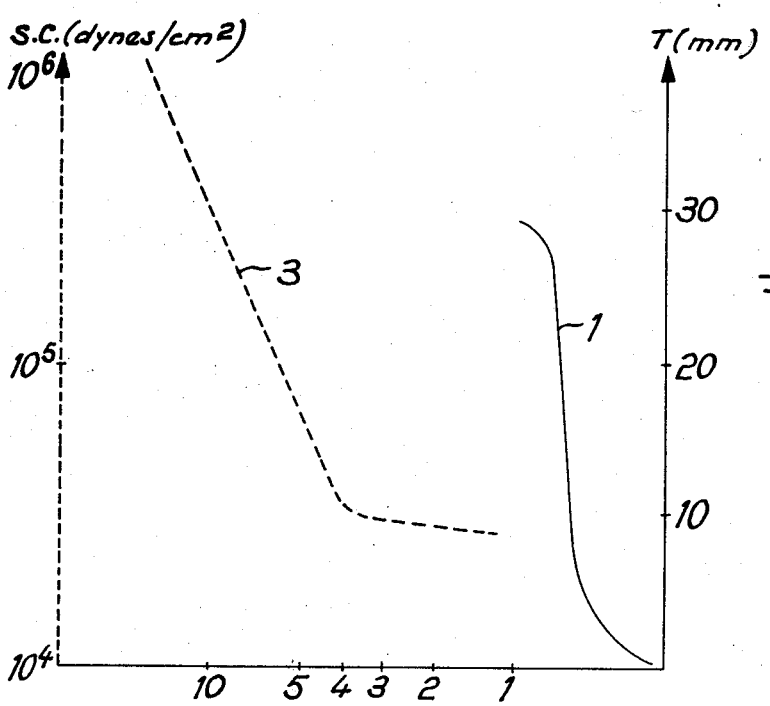

Curves 1 and 3, drawn as indicated in the preceding Examples, are shown in FIG. 4.

EXAMPLE 5 (FIG. 5)

A liquid sand was prepared with the following constituents:

— 50 kg silica sand having a mesh size of 60 AFS;
— 1 kg of a urea-formaldehyde-furfuryl alcohol polycondensation resin (U/F/FA) in which the furfuryl alcohol represents 60% of the resin, F/U is 2.3 and the viscosity was 1.5 poise;
— 220 g phosphoric acid;
— 120 g sulphuric acid;
— 510 g water;
— 50 g dodecylbenzene sulphonic acid and
— 10 g p-toluene sulphonic acid as surface-active agents.

Mixing takes place under the same conditions as described in the above Examples and a liquid sand was obtained having the following characteristics:

— diameter over which it spread: 375 mm;
— settling after vibration: 100 mm;
— density: 1.62.

Figure 5:
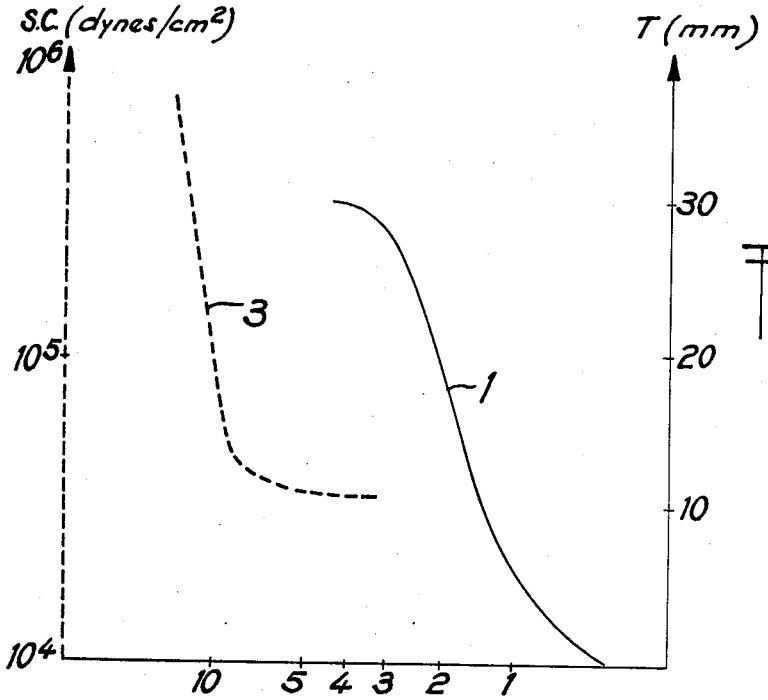
Figure 6:
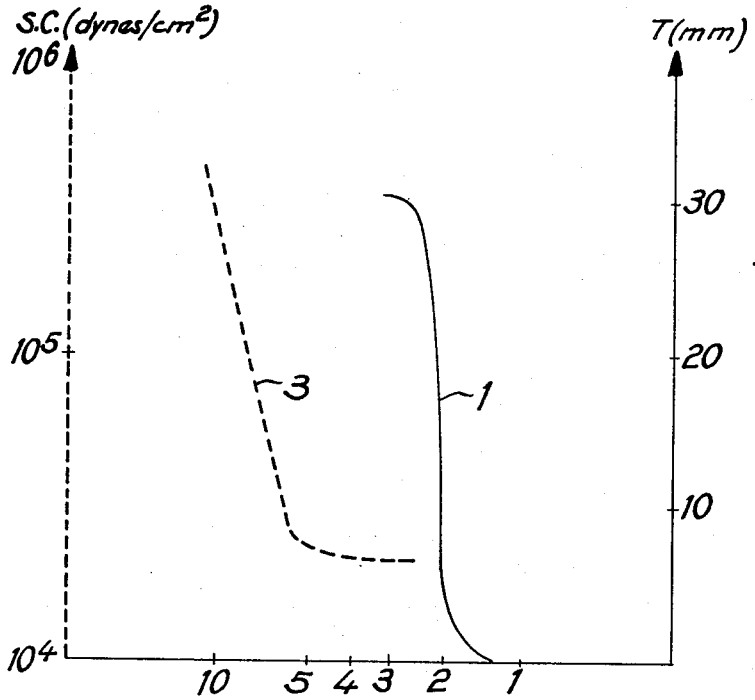
Figure 7:
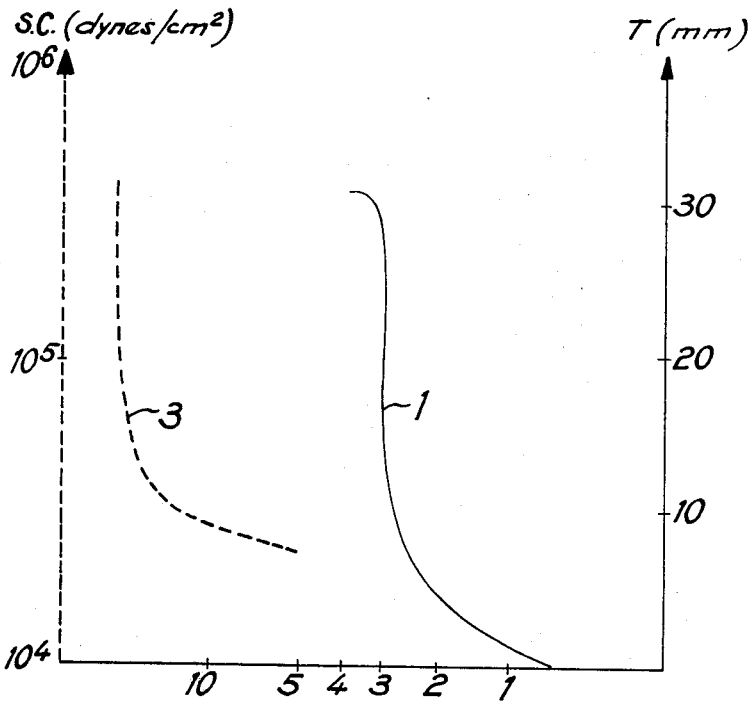

Curves 1 and 3 were drawn as previously and are shown in FIG. 5.

EXAMPLE 6 (FIG. 6)

A mixture of liquid sand was prepared having the following constituents:

— 50 kg silica sand having a mesh size of 60 AFS;
— 0.75 kg of a (U/F/FA) resin, in which the furfuryl alcohol represents 85% of the resin, and which had the following characteristics; $N_2$ = 0.75%; viscosity: 0.4 poise; IR = 1.50;
— 229 g phosphoric acid;
— 153 g sulphuric acid;
— 663 g water;
— 52 g methanol;
— 88 g dodecylbenzene sulphonic acid and
— 115 g p-toluene sulphonic acid.

The curves 1 and 3 were drawn in the same manner as described previously.

A liquid sand was obtained whose characteristics are as follows:

— diameter over which it spread: 360 mm;
— settlement after vibration: 75 mm;
— density 1.55;
— resistance to compression:
$R_c$ 1 hour: 2 daN/cm²;
$R_c$ 5 hours: 4 daN/cm²;
$R_c$ 24 hours: 10 daN/cm².

This example shows that the amount of furfuryl alcohol in the resin may reach 85. provided that this alcohol is in a polycondensed form. The percentage of this binding agent in the liquid sand mixture has been reduced to 1.5% (in place of 2% in most of the preceding examples) since at higher percentages, it is no longer possible to fluidize the sand mixture and consequently the mechanical resistances are thus quite low. The percentage of nitrogen in the resin is very low and this sand mixture would be suitable for moulding steel.

EXAMPLE 7 (FIG. 7)

A mixture of liquid sand was prepared with the following constituents;

— 50 kg sand having a mesh size of 60 AFS;
— 1 kg resin constituted by a mixture of a furfuryl alcohol-formaldehyde precondensate on the one hand and urea-formaldehyde resin on the other hand, i.e. (Fa/F) plus UF; the furfuryl alchol represents 70% of ths mixture and the urea-formaldehyde resin used has the following characteristics:

F/U = 1.9; dry material: 66%; viscosity: 6 poises; IR: 1.46;

— 220 g phosphoric acid;
— 180 g sulphuric acid;
— 500 g water;

— 50 g dodecylbenzene sulphonic acid and
— 50 g p-toluene sulphonic acid.

The curves 1 and 3 were drawn in the same manner as described previously and a liquid sand mixture obtained had the following characteristics:

— diameter over which it spread: 375 mm;
— settling after vibration: 90 mm;
— density: 1.58;
— resistance to compression: $R_c$ 30 minutes: 1.2 daN/cm²;
$R_c$ 1 hour: 4.5 daN/cm²;
$R_c$ 5 hours: 8 daN/cm²;
$R_c$ 24 hours: 13 daN/cm².

Therefore with a binding agent which contains little nitrogen and a large amount of furfuryl alcohol a sand mixture is obtained whose mechanical resistance is greater than that obtained in the previous Example.

EXAMPLE 8

An attempt was made to prepare a liquid sand mixture with the following constituents;

— 50 kg of silica sand having a mesh size of 60 AFS;
— 1 kg resin obtained by prepolymerizing a urea-formaldehyde syrup with furfuryl alcohol in the proportions of 60% furfuryl alcohol and 40% urea-formaldehyde resin whose nitrogen content was 5.85%. However it was not possible to fluidize the sand with any of the surface tension agents or diluents used.

Figure 8:
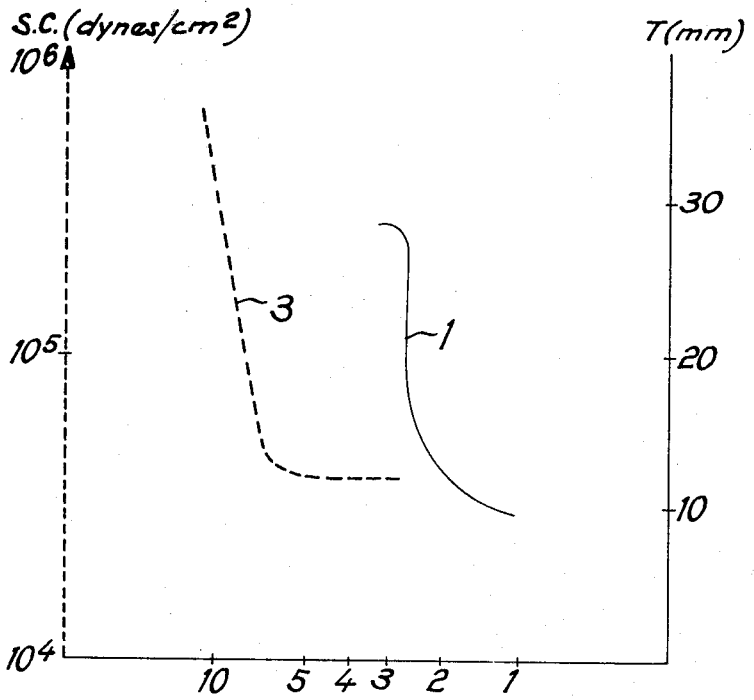

EXAMPLE 8b (FIG. 8)

A liquid sand was prepared with the following constituents;

— 50 kg sand having a mesh size of 60 AFS;
— 1 kg of a resin constituted by the preceding (FA/UF) resin to which was added a urea-formaldehyde resin so as to bring the percentage of furfuryl alcohol in the mixture to 55%; the F/U ratio of the urea-formaldehyde resin being 2.3;
— 150 g phosphoric acid;
— 90 g sulphuric acid;
— 50 g methanol;
— 550 g water;
— 60 g dodecylbenzene sulphonic acid and
— 100 g p-toluene sulphonic acid.

A liquid sand was obtained which had the following characteristics:

— diameter over which it spread: 365 mm;
— settlement after vibration: 70 mm;
— density: 1.60;
— resistance to compression:
$R_c$ 30 minutes: 2 daN/cm²;
$R_c$ 1 hour: 5 daN/cm²;
$R_c$ 5 hours: 13 daN/cm²;
$R_c$ 24 hours: 21 daN/cm².

The curves 1 and 3, drawn as previously described, are shown in FIG. 8.

EXAMPLE 9 (FIG. 9)

The resin of Example 8b was further polymerized by heating for 1 hour 30 minutes, until boiling, in the presence of an acid catalyst, the resultant resin was then neutralised to a pH of M and used as a binding agent in this Example.

A sand mixture was thus prepared with the following constituents:

— 50 kg sand having a mesh size of 60 AFS;
— 1 kg of a "superpolymerized" (FA/UF) resin whose furfuryl alcohol content was 60%, viscosity 35 poises, F/U ratio 2.3 and refractive index 1.50;
— 150 g phosphoric acid;
— 90 g sulphuric acid;
— 50 g methanol;
— 550 g water;
— 60 g dodecylbenze sulphonic acid;
— 10 g p-toluene sulphonic acid.

Figure 9:
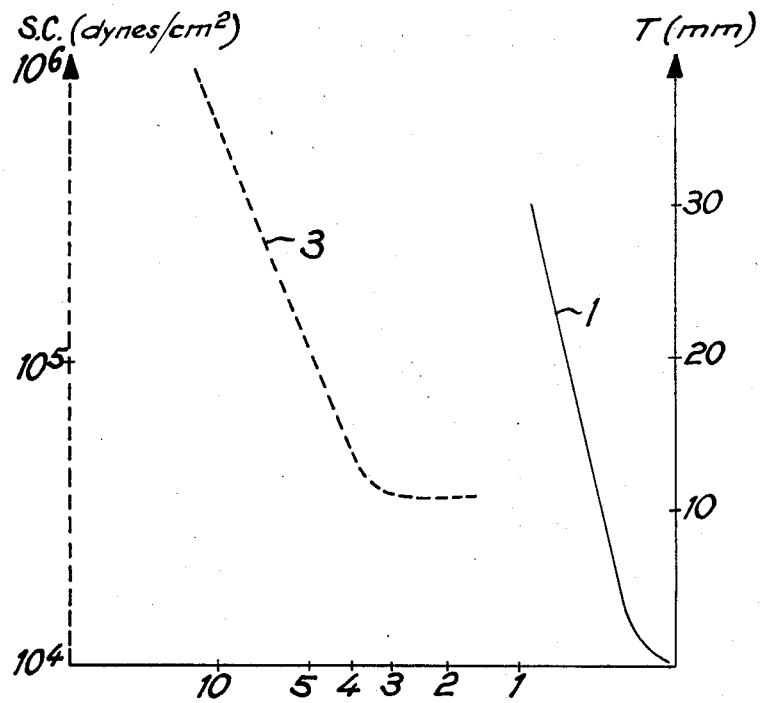

The curves 1 and 3, drawn as previously, are shown in FIG. 9 and the characteristics of the sand obtained are as follows;

— diameter over which it spread: 375 mm;
— settlement after vibration: 90 mm;
— density: 1.60.

EXAMPLE 10

A liquid sand mixture was prepared using, as the binding agent, the "superpolymerised" (FA/UF) resin of Example 9 to which was added furfuryl alcohol in order to bring the percentage of the latter in the mixture to 65%; the various constituents were as follows;

— 50 kg sand having a mesh size of 60 AFS;
— 0.870 kg "superpolymerised" (FA/UR) resin;
— 0.130 kg furfuryl alcohol;
— 150 g phosphoric acid;
— 90 g sulphuric acid;
— 50 g methanol;
— 500 g water;
— 110 g dodecylbenzene sulphonic acid and
— 100 g p-toluene sulphonic acid.

A liquid sand was obtained which had the following characteristics;

— diameter over which it spread: 370 mm;
— settlement after vibration: 100 mm;
— density: 1.58.

Several attempts were made to increase the furfuryl alcohol percentage to 70% by addition of the alcohol to the "superpolymerised (FA/UF) resin" but the rate of free furfuryl alcohol was too high and it was not possible to fluidize the mixtures.

Figure 10:
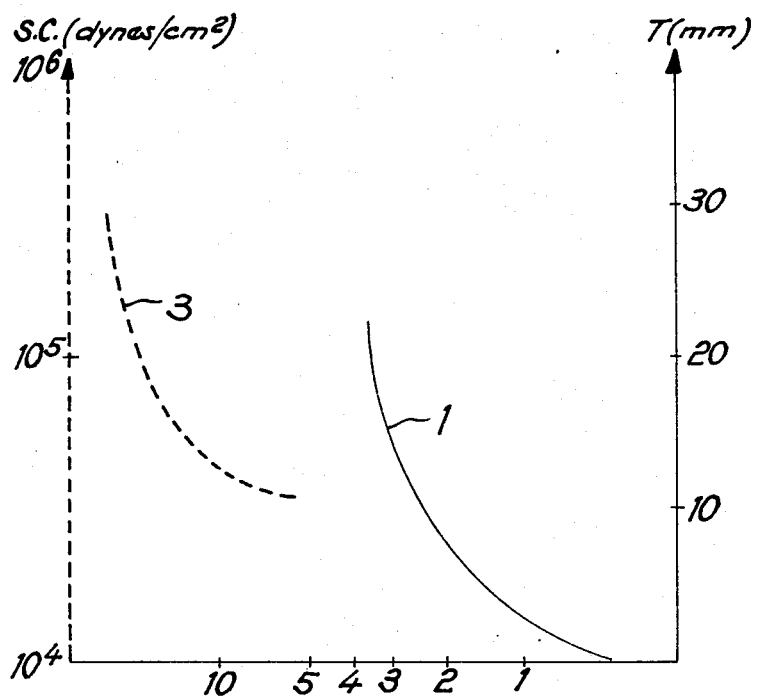

Curves 1 and 3 are shown in FIG. 10.

EXAMPLE 11

A mixture of liquid sand was prepared using, as a binding agent, a mixture of a precondensate of furfuryl alcohol and a urea-formaldehyde resin, the amount of furfuryl alcohol in this mixture being 70%. Despite the high level of furfuryl alcohol in the mixture, it was possible to fluidize the mixture and obtain a sand whose characteristics were virtually the same as those of Example 7.

Examples 5 to 11 thus show that it is possible to use resins containing up to 70 and even 85% furfuryl alcohol provided that the latter is in a polycondensed form.

EXAMPLE 12 (FIG. 10)

This example shows that it is possible to prepare a liquid sand, with a urea-formaldehyde-furfuryl alcohol resin, using as a surface-active agent an anion active agent.

A liquid sand mixture was prepared with the following constituents:

— 50 kg sand having a mesh size of 60 AFS;
— 1 kg of a mixture comprising 45% urea-formaldehyde resin and 55% furfuryl alcohol; the characteristics of the urea-formaldehyde resin being the same as those of Example 3;

— 0.90 kg of a catalyst constituted by 17% phosphoric acid, 21% sulphuric acid and 62 % water;
— 0.15 kg sodium mono-laurylethanolamide-sulphosuccinate as a surface-active agent;
— 0.10 kg water.

The mixture was produced in the following manner: the sand, resin, surface-active agent and water were firstly mixed for 1 minute, the acid catalyst was then added and mixing carried out for a further 30 seconds. A liquid sand was obtained having the following characteristics:

— diameter over which it spread: 360 mm;
— settling after vibration: 30 mm;
— density: 1.50;
— resistance to compression:
$R_c$ 30 minutes: 0.5 daN/cm$^2$;
$R_c$ 1 hour: 2 daN/cm$^2$;
$R_c$ 5 hours: 4 daN/cm$^2$;
$R_c$ 24 hours: 9 daN/cm$^2$.

The curves 1 and 3 are illustrated in FIG. 10.

EXAMPLE 13 (FIG. 11)

This example shows that it is possible to prepare a liquid sand mixture, the binding agent of which is a urea-formaldehyde-furfuryl alcohol resin using a cation-active agent as a surface-active agent.

A mixture is produced with the following constituents;

— 50 kg sand having a mesh size 60 AFS;
— 1 kg of a mixture of 45% uea-formaldehyde resin (having the same characteristics as those of Example 3) and 55% furfuryl alcohol;
— 1 kg of a catalyst containing 18% phosphoric acid, 18% sulphuric acid and 64% water;
— 0.05 kg laurylamine acetate as a surface-active agent;
— 0.05 kg water.

The mixture was produced in the same manner as in the preceding Example.

A liquid sand was obtained having the following characteristics;

— diameter over which it spread: 390 mm;
— settling after vibration: 90 mm;
— density: 1.60;
— resistance to compresson:
$R_c$ 30 minutes: 1.5 daN/cm$^2$;
$R_c$ 1 hour: 3 daN/cm$^2$;
$R_c$ 5 hours: 5 daH/cm$^2$;
$R_c$ 24 hours: 10 daN/cm$^2$.

Figure 11:
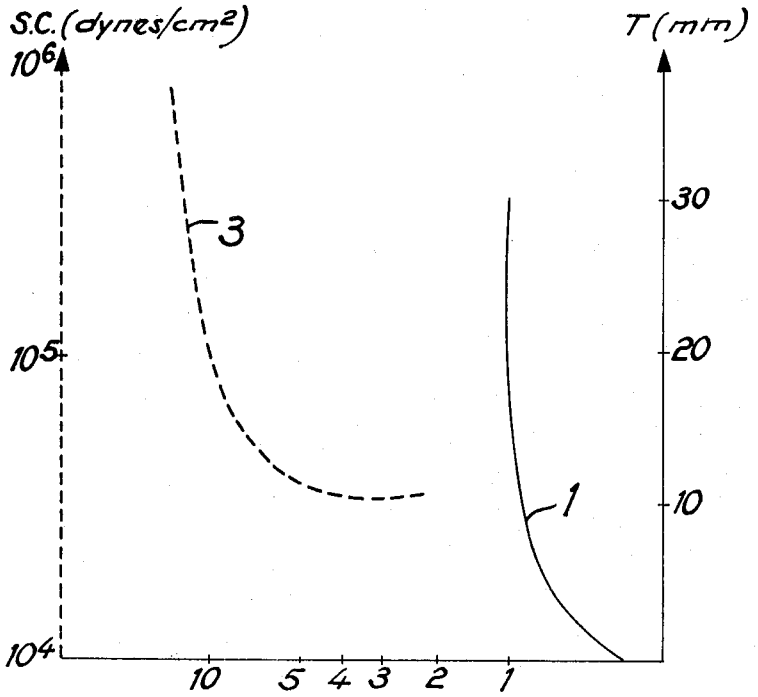

The curves 1 and 3 are shown in FIG. 11.

A liquid sand was prepared in the same manner as previously, out using oleylamine acetate in place of laurylamine acetate, and identical results were obtained.

It will be noted, according to these two examples, that the resistances of the sand obtained are lower than the cases in which the surface-active agent is an acid or a mixture of alkylbenzene sulphonic acids although the percentages of the acid catalyst are higher.

What we claim is:

1. A fluidized self hardening mixture for making foundry molds and cores of increased mechanical resistance comprising sand, a liquid, a mineral or organic acid as a setting agent, 0.5–5% by weight with respect to the weight of the sand of a binder which is (a) a urea-formaldehyde resin, wherein the F/U ratio is comprised between 1 and 4, (b) a urea-formaldehyde-furfuryl alcohol resin, (c) a mixture of urea-formaldehyde resin and furfuryl alcohol, the proportion of furfuryl alcohol in the mixture being up to 55%, (d) a mixture of urea-formaldehyde resin and urea-formaldehyde-furfuryl alcohol resin and a surface-active agent capable of producing a foam which begins to subside before the sand begins to set, wherein the surface-active agent is n-dodecyl benzene sulfonic acid or a mixture of n-dodecyl benzene sulfonic acid and p-toluene sulfonic acid; in the proportion of 0.01 to 2% by weight of surface-active agent with respect to the total weight of the liquid sand.

2. The mixture according to claim 1 wherein the binding agent consists of at least one resin consisting of a polycondensate of urea, formaldehyde and furfuryl alcohol and containing up to 85% furfuryl alcohol.

3. The mixture according to claim 1 which contains a setting catalyst which is phosphoric acid or sulfuric acid or a mixture thereof.

4. A method of making foundry molds and cores from a mixture of self hardening liquid sand, which comprises forming a mixture of sand and a binding agent in amount of 0.5–5% of the weight of the sand, said binding agent being (a) a urea-formaldehyde resin wherein the F/U ratio is comprised between 1 and 4, or (b) a urea-formaldehyde furfuryl alcohol resin or (c) a mixture of urea-formaldehyde resin and furfuryl alcohol the proportion of furfuryl alcohol in the mixture being up to 55%, or (d) a mixture of urea-formaldehyde resin and urea-formaldehyde furfuryl alcohol resin, adding liquid constituents which comprise a mineral or an organic acid which acts as the setting agent and surface-active agent in an amount of 0.01–2% based on the weight of the sand, said surface-active agent being capable of producing a foam which begins to subside before the sand begins to set, the surface-active agent being, n-dodecyl benzene sulfonic acid or a mixture of n-dodecyl benzene sulfonic acid and p-toluene sulfonic acid, mixing until the mixture is fluidized, subjecting the mixture to mechanical stress as soon as natural compression begins forming molds and cores and allowing said molds and cores to harden.

* * * * *